United States Patent [19]

Filipowicz et al.

[11] 4,329,001

[45] May 11, 1982

[54] DISPENSER FOR FOLDED SHEETS OF FLEXIBLE MATERIAL

[75] Inventors: Edwin A. Filipowicz, Greenfield; Robert W. Cornell, Hales Corners; Scott J. Collins, Brown Deer, all of Wis.

[73] Assignee: Georgia-Pacific Corporation, Portland, Oreg.

[21] Appl. No.: 118,771

[22] Filed: Feb. 5, 1980

[51] Int. Cl.[3] ..... B65H 1/08; A47B 63/00

[52] U.S. Cl. ..... 312/71; 312/188; 312/190; 312/350; 221/53; 221/59

[58] Field of Search ..... 312/71, 188, 190, 191, 312/341 NR, 338, 350; 221/53, 55, 57, 59

[56] References Cited

U.S. PATENT DOCUMENTS

| | | | |
|---|---|---|---|
| 992,253 | 5/1911 | Richardson | 312/350 |
| 1,993,885 | 3/1935 | Horwitt | 221/59 |
| 2,175,025 | 10/1939 | Hooven | 312/350 |
| 2,586,197 | 2/1952 | Aubertin | 221/59 |
| 2,751,272 | 6/1956 | Hutzelman | 312/341 R |
| 2,881,948 | 4/1959 | Chaplin | 221/57 |
| 3,203,586 | 8/1965 | Downham | 221/55 |
| 3,208,636 | 9/1965 | Filipowicz | 221/57 |
| 3,214,227 | 10/1965 | Filipowicz | 312/71 |
| 3,370,748 | 2/1968 | Koerper et al. | 221/59 |
| 3,550,978 | 12/1970 | Magee | 312/350 |

*Primary Examiner*—Victor N. Sakran

*Attorney, Agent, or Firm*—Schuyler, Banner, Birch, McKie and Beckett

[57] ABSTRACT

A dispenser for folded paper napkins including an enclosed cabinet having an opening in the front thereof through which napkins may be removed individually. A pair of V-shaped guides are mounted on inside surfaces of opposite sides of the cabinet. A drawer for holding a supply of folded napkins has a pair of V-shaped ribs formed along opposite sides which slidably engage the guides to movably support the drawer within the cabinet. A carriage assembly including a pressure plate for engaging the rear of the napkin supply in the drawer has a pair of V-shaped slides affixed to opposite sides. The sides slidably engage the ribs to movably support the carriage assembly in the drawer. A pair of constant force springs are affixed to the cabinet and engage the rear of the pressure plate to urge the plate and carriage assembly forwardly of the drawer against the rear of the napkin supply to facilitate individual removal of the napkins through the cabinet opening.

12 Claims, 6 Drawing Figures

DISPENSER FOR FOLDED SHEETS OF FLEXIBLE MATERIAL

BACKGROUND OF THE INVENTION

This invention relates to dispensers for folded sheets of flexible material, and particularly to a folded paper napkin dispenser.

DESCRIPTION OF THE PRIOR ART

Folded paper napkin dispensers have been employed widely in commercial eating establishments. Generally, such dispensers comprise an enclosed cabinet for holding a supply of napkins from which the napkins may be removed individually by users. The dispensers are self-contained units which are adapted to be placed on table and counter top to convenience users. Representative of such dispensers is the device disclosed in Filipowicz U.S. Pat. No. 3,214,227. This dispenser includes an enclosed cabinet, a drawer slidably mounted in the cabinet for holding a supply of napkins to be dispensed and a carriage assembly movably mounted in the drawer for urging the napkins toward an opening in the front of the drawer. The drawer is slidably mounted on flanges affixed to opposite sides of the cabinet and the carriage assembly is movably mounted in the drawer by a plurality of rollers carried in tracks also affixed to opposite sides of the cabinet. The carriage assembly roller support tracks are spaced vertically from the drawer supporting flanges. In this respect, it will be appreciated that a rather complex arrangement of flanges, tracks and rollers are required to support the drawer and carriage assembly. This complexity undesirably adds to the manufacturing and maintenance costs of the dispenser.

SUMMARY OF THE PRESENT INVENTION

The dispenser of the present invention overcomes the aforementioned deficiencies of the prior art dispensers by providing an economical and reliable structural arrangement of components. In particular, the dispenser of the invention includes a simple and effective arrangement for slidably mounting a napkin containing drawer within a cabinet and a napkin engaging carriage assembly within the drawer.

Basically described the dispenser of the invention comprises: a cabinet having a front and a pair of opposed sides, said cabinet front having an opening therein; a pair of guides respectively affixed to the inner sufaces of said cabinet sides; a drawer for holding a supply of folded sheets of flexible material and having a pair of ribs respectively formed along opposite sides of said drawer, said ribs respectively slidably engaging said guides to movably support said drawer in said cabinet; a carriage assembly for engaging the rear of said sheet supply and including a pair of slides respectively affixed to opposite sides of said assembly, said slides respectively engaging said ribs to movably support said assembly in said drawer; and means associated with said cabinet for urging said carriage assembly forwardly of said drawer to thereby urge said sheets forwardly of said drawer and facilitate removal of said sheets individually through said cabinet front opening.

Preferably, the guides, ribs and slides all have similarly shaped cross-sections with divergent sides. For example, these elements all may have V-shaped transverse cross-sections.

Also preferably, the dispenser includes at least one bearing member made from a material having relatively high lubricity, such as nylon, interposed between each slide and the associated rib to promote sliding movement between the slides and ribs. The bearing member may be the head of a nylon rivet or similar device.

With the foregoing in mind, it is an object of the present invention to provide a dispenser for folded sheets of flexible material which is more economical and reliable than the prior art dispensers.

It is a further object of the invention to provide a dispenser for folded sheets of flexible material in which the primary components of the dispenser are movably supported with respect to each other by a plurality of relatively simple, similarly shaped elements.

It is also an object of the invention to provide a dispenser for folded sheets of flexible material in which unique, relatively simple and highly effective means are employed to provide a high degree of lubricity between relatively movable components of the dispenser.

It is an additional object of the invention to provide a dispenser for folded sheets of flexible material in which a drawer for holding a supply of sheets is slidably mounted in a cabinet by a pair of channel members affixed to the cabinet and a mating pair of ribs formed in the drawer, and a carriage assembly for engaging the rear of the sheet supply is movably mounted in the drawer by the drawer ribs and a mating pair of slides affixed to the carriage assembly.

BRIEF DESCRIPTION OF THE DRAWINGS

The foregoing and further objects of the invention will be better understood by reference to the following detailed description of a preferred embodiment thereof given in connection with the following drawings, wherein.

DESCRIPTION OF A PREFERRED EMBODIMENT

Figure 6:
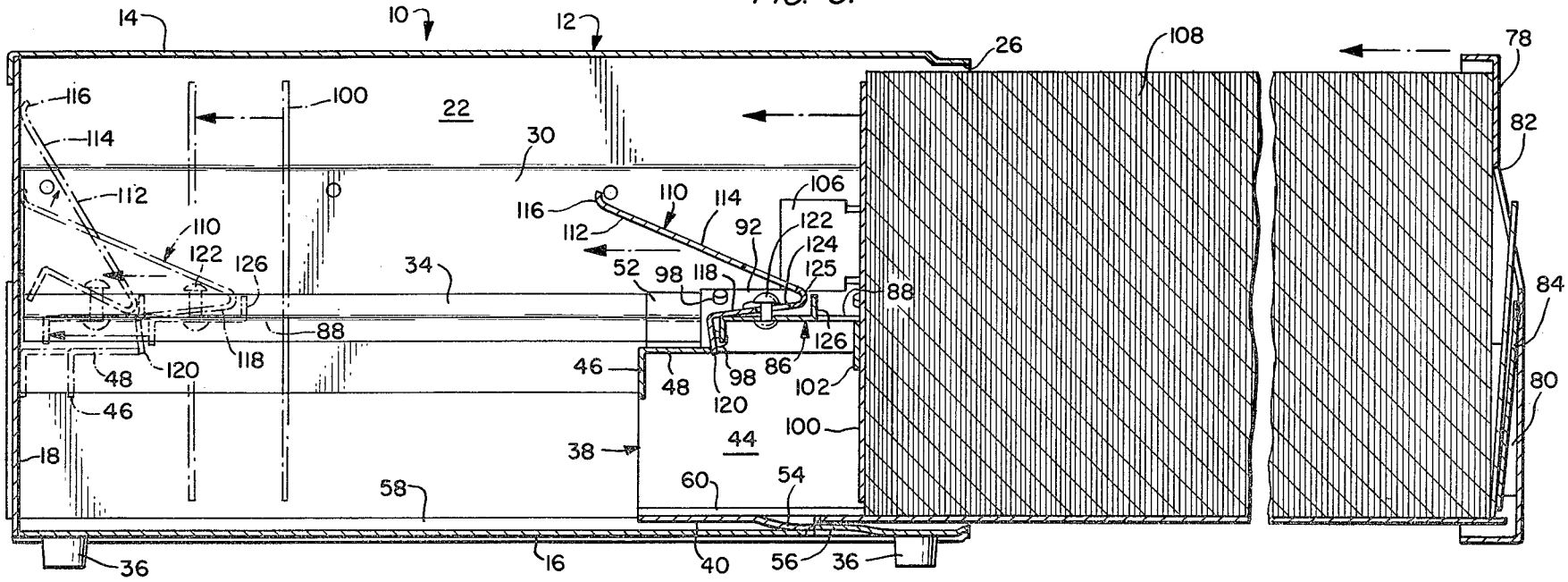
FIG. 6 is a sectional view similar to FIG. 3 showing various relative positions of the drawer and cabinet of the dispenser of the invention.

A perferred embodiment of the dispenser of the invention is illustrated in the drawings, as designated by reference numeral 10. Dispenser 10 includes a cabinet 12 having a top 14, a bottom 16, a back 18 and opposed sides 20 and 22. Top 14, bottom 16, back 18 and sides 20 and 22 preferably are made from sheet metal members formed with appropriate flanges and overlapping portions, and are riveted or otherwise secured together to form an integral unit. A decorative indented strip 24 may be formed at the sides of the cabinet to enhance the appearance of the dispenser and identify its source. The front of cabinet 12 defines an opening 26 (FIG. 6).

Respectively mounted on the inside surfaces of cabinet sides 20 and 22 are flat, relatively heavy gauge, sheet metal strips 28 and 30 having channel-shaped guides 32 and 34 respectively formed at the lower edges thereof.

Guides members 32 and 34 extend substantially the full length of sides 20 and 22 and have V-shaped transverse cross-sections. Cabinet 12 also has a plurality of feet 36 affixed to bottom 16, such feet being made from a conventional shock resistant, non-skid material.

Mounted within cabinet 12 is a drawer 38 having a bottom 40 and opposed sides 42 and 44. Affixed to and extending between sides 42 and 44 at the rear of drawer 38 is a bracket 46 having a forwardly extending lip 48 for a purpose described hereinbelow. The upper ends of sides 42 and 44 respectively are formed into ribs 50 and 52. Ribs 50 and 52 extend substantially the length of drawer 38 and have V-shaped transverse cross-sections shaped similarly to the transverse cross-sections of guides 32 and 34. The outer surfaces of ribs 50 and 52 respectively slidably engage the innner surfaces of guides 32 and 34 to slidably mount drawer 38 within cabinet 12. As is apparent, the interaction of ribs 50 and 52 with guides 32 and 34 permits drawer 38 to be moved forwardly and rearwardly with respect to cabinet 12.

A downwardly extending tab 54 is formed in drawer bottom 40 and interacts with an upwardly extending tab 56 formed in cabinet bottom 16 to prevent drawer 38 from unintentionally being removed from cabinet 12. In order to completely remove drawer 38 from cabinet 12, drawer bottom 40 and cabinet bottom 16 intentionally must be separated far enough apart to permit tab 54 to slide forwardly past tab 56.

A pair of inwardly and longitudinally extending ribs 58 are formed in cabinet bottom 16 to provide a pair of relatively thin, longitudinally extending bearing surfaces for drawer 38 to slide on.

A latch 62 is attached to drawer 38 to releasably secure the drawer to the cabinet. Latch 62 includes a latch arm 64 pivotally connected at pivot pin 66 to the inside surface of drawer side 44. Arm 64 extends forwardly of pin 66 along the inside surface of side 44, through an opening 68 formed in the side, and forwardly of opening 68 along the outside surface of the side to form a tab 69. A latch actuator in the form of a small cylindrical post 70 is affixed to the forward end of tab 69 and extends inwardly through an opening 72 in drawer side 44 to be accessible from the interior of the drawer. Tab 69 is adapted to be received by a notch 74 formed in the upper edge of the sheet metal member forming cabinet bottom 16. Further, an upwardly sloping camming surface 76 if formed at the forward portion of such edge.

As drawer 38 is slid rearwardly into cabinet 12, tab 69 engages and is pivotally cammed upwardly by surface 76. In this manner, tab 69 is raised to a position for automatic gravitation into notch 74 when drawer 38 is fully received in cabinet 12 to releasably lock the drawer in the cabinet. To release tab 69 from notch 74, a user manually lifts actuator 70 to thereby lift tab 69 out of notch 74 and permit forward movement of the drawer with respect to the cabinet. As will be apparent, latch 62 comprises a relatively simple mechanism and requires no springs or other mechanical biasing means in order to perform its releasable locking function.

Figure 1:
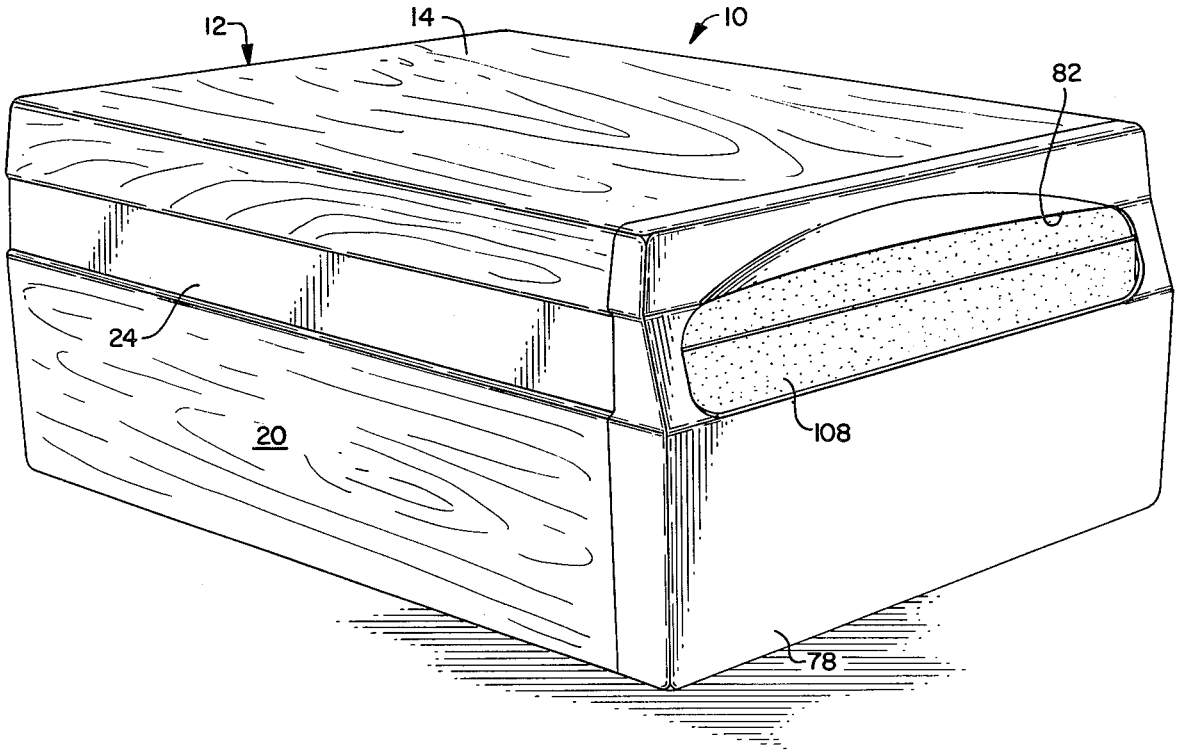
FIG. 1 is a perspective view of the dispenser of the invention.
Figure 3:
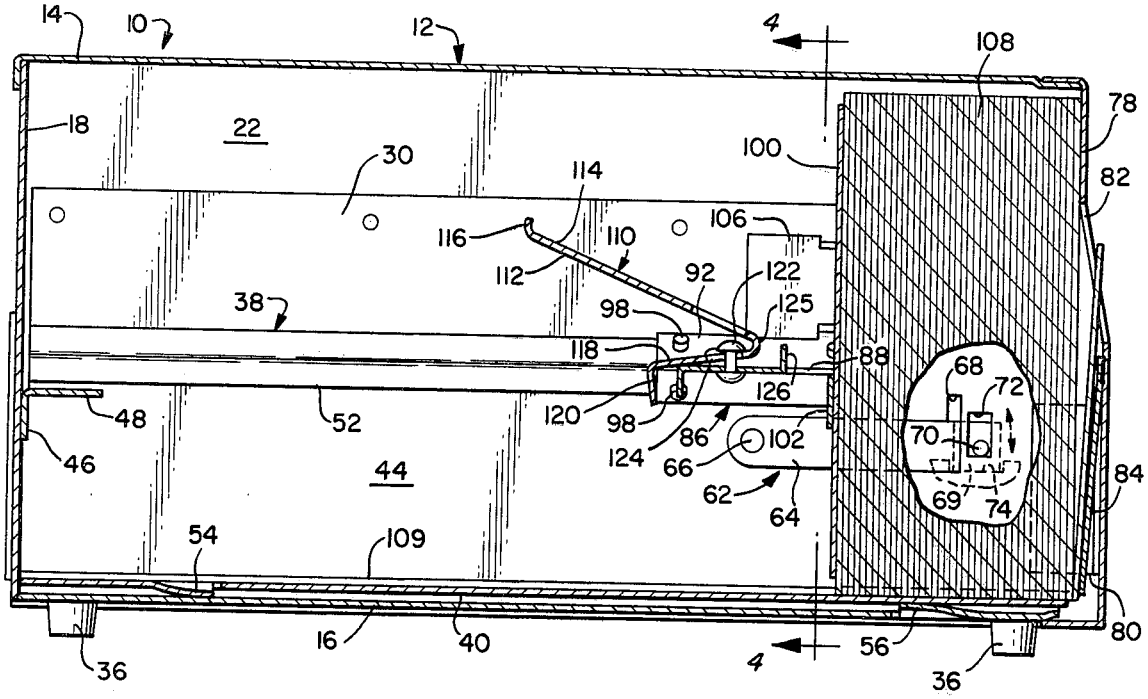
FIG. 3 is a sectional view taken on line 3—3 of FIG. 2.
Figure 4:
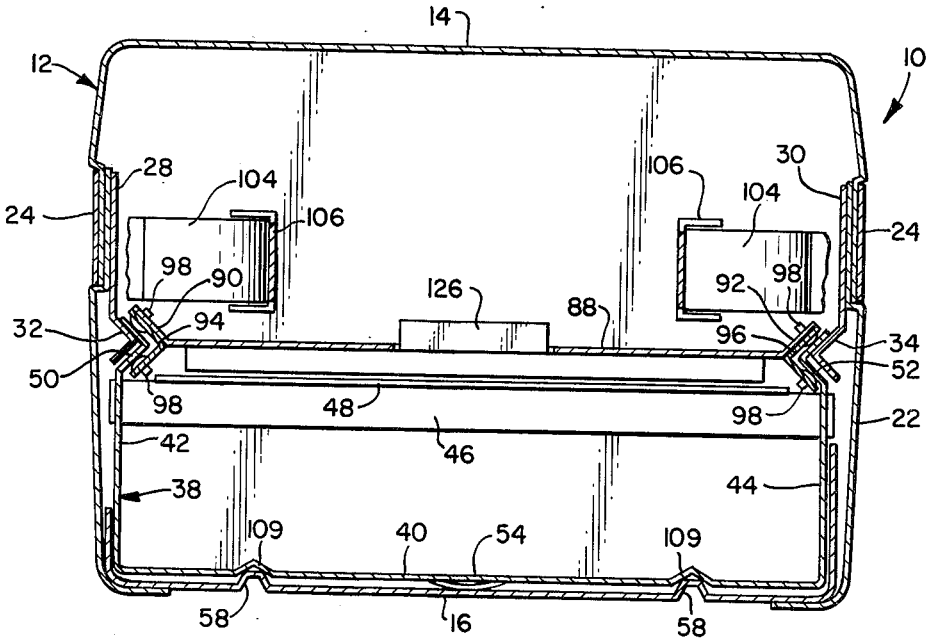
FIG. 4 is a sectional view taken on line 4—4 of FIG. 3.
Figure 5:
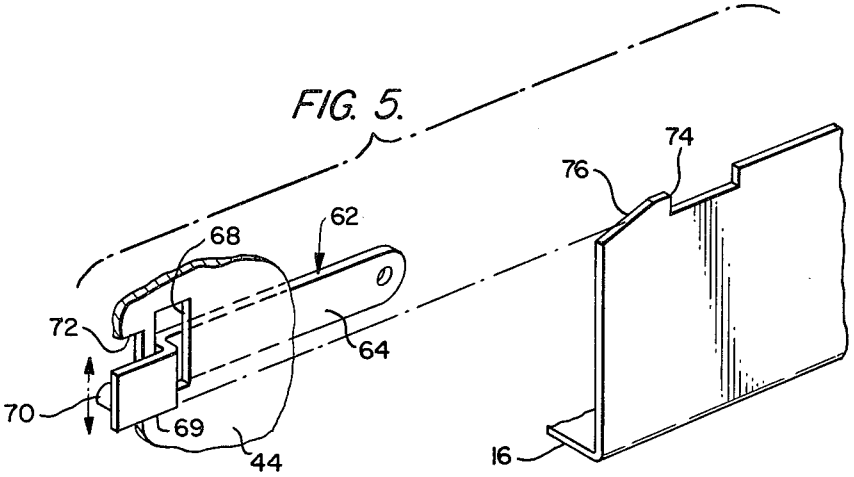
FIG. 5 is an exploded perspective view of a latch employed in the dispenser of the invention.

A cabinet front 78 is affixed to drawer 38 by brackets 80. Front 78 has an inclined opening 82 therein and a guide plate 84 affixed to the inside surface thereof to facilitate the individual removal of napkins from dispenser 10. When drawer 38 is moved from the open position shown in FIG. 6, to the closed position shown in FIG. 3, the perimetral edges of front 78 overlap the adjoining edges of cabinet top 14, cabinet bottom 16 and cabinet sides 20 and 22 to provide a smooth and decorative finish (FIG. 1).

Mounted within drawer 38 is a carriage assembly 86 including a support bridge 88 disposed transversely of the drawer. The outer edges of bridge 88 are bent upwardly, as at 90 and 92, and respectively have affixed thereto a pair of slides 94 and 96. Slides 94 and 96 have V-shaped transverse cross-sections shaped similarly to the transverse cross-sections of guides 32 and 34 and ribs 50 and 52. The outer surfaces of slides 94 and 96 respectively slidably engage the inner surfaces of ribs 50 and 52. A plurality of rivets 98 are affixed to slides 94 and 96 with the heads of the rivets disposed between the mating surfaces of the slides and ribs. Rivets 98 are made from a material of relatively high lubricity, such as nylon, to facilitate relative sliding movement between the slides and ribs. As is apparent, the interaction of slides 94 and 96 with ribs 50 and 52 permits carriage assembly 86 to be moved forwardly and rearwardly within drawer 38.

Figure 2:
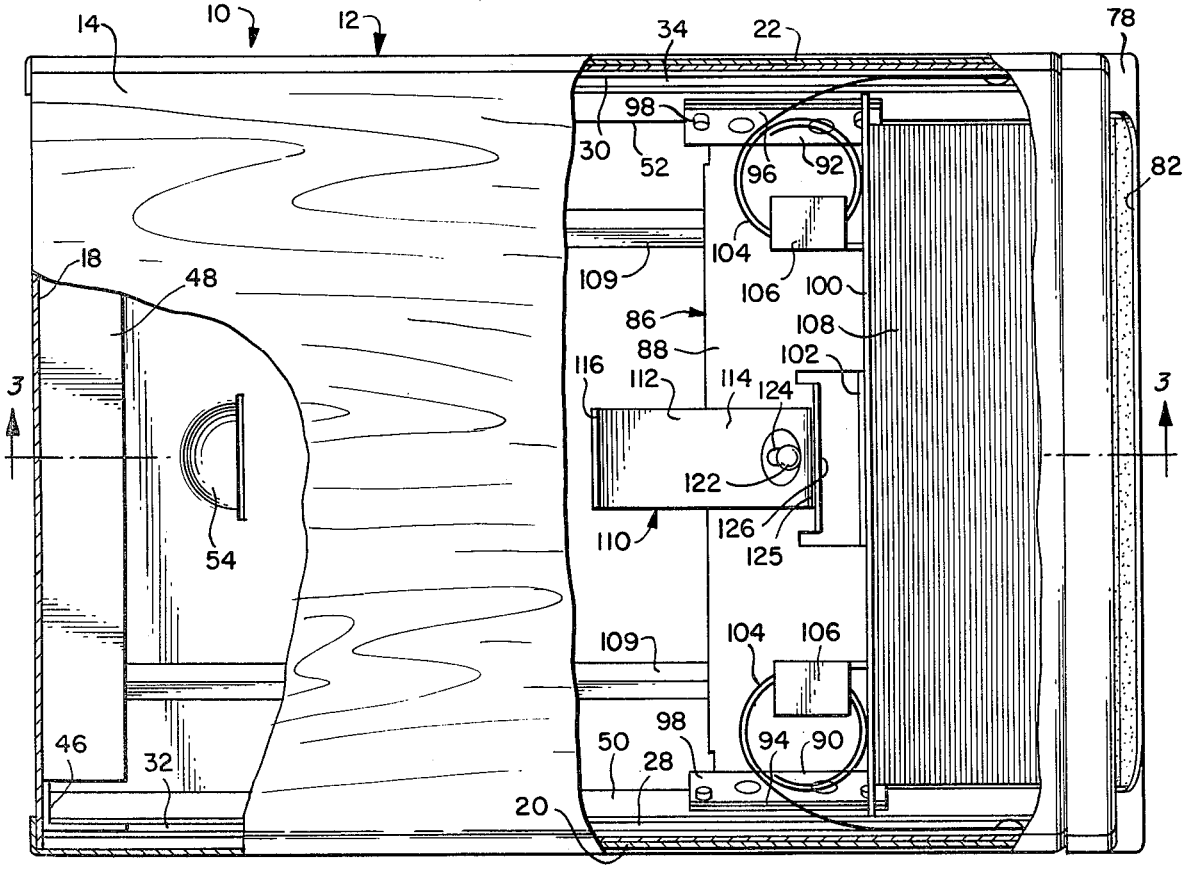
FIG. 2 is a horizontal sectional view of the dispenser of the invention.

A pressure plate 100 is affixed to a flange 102 formed at the forward edge of bridge 88. As best illustrated in FIG. 2, one end of a constant force coiled spring 104 is affixed to each of strips 28 and 30. Springs 104 preferably are made from tempered spring steel. The body of each spring 104 is disposed behind pressure plate 100 and is held in position rather loosely by a C-shaped bracket 106 integrally formed in pressure plate 100. Springs 104 bias carriage assembly 86 forwardly within drawer 38.

Drawer 38 is adapted to hold a supply of folded paper napkins 108 to be dispensed. To load drawer 38, the drawer is moved to its open position, as shown in FIG. 6. Napkins 108 are then placed in the drawer in front of pressure plate 100. As the napkins are placed in the drawer, pressure plate 100 engages the rear of the nakpin supply, and carriage assembly 86 is moved progressively rearwardly within the drawer.

A pair of inwardly and longitudinally extending ribs 109 are formed in drawer bottom 40 to provide a pair of relatively thin, longitudinally extending bearing surfaces for the napkins 108 in drawer 38 to ride on.

An anti-overload mechanism 110 also is provided to relieve excessive pressure on napkins 108 that may be caused by loading an excessive volume of napkins into drawer 38, and which can result in more than one napkin being removed through opening 82 upon the attempted removal of a single napkin. Mechanism 110 includes a lever 112 having a relatively longer upper leg 114 terminating in an upwardly turned end 116 and a relatively shorter lower leg 118 terminating in a downwardly turned flange 120. Legs 114 and 118 are conntected together at their forward ends to form an apex 125 and define an acute angle of approximately 30° therebetween. Lever 112 is connected to bridge 88 by a rivet 122 which passes through the bridge and a slot 124 formed in leg 118. Rivet 122 is of sufficient length to permit lever 112 to be rockably pivoted upwardly and downwardly on bridge 88. The forward edge of apex 125 is positioned adjacent and rearwardly of an upturned flange 126 integrally formed on the upper surface of bridge 88.

When drawer 38 is open, as shown in solid lines in FIG. 6, lever 112 is pivoted to a downward position under the influence of gravity. As napkins 108 are placed into drawer 38 and carriage assembly 86 is moved progressively rearwardly of the drawer, the lower edge of flange 120 eventually abuts the forward edge of rib 48 and apex 125 abuts flange 126 to prevent any further rearward movement of the carriage assembly. This arrangement thus limits the volume of napkins 108 that may be loaded into drawer 38.

When drawer 38 is closed, as shown in phantom lines in FIG. 6, device 110 is adapted to provide additional space within the drawer for accommodating napkins 108 in a relaxed, unstressed condition. To achieve this result, end 116 of leg 114 slidably engages cabinet back 18 when drawer 38 is inserted into cabinet 12. This causes lever 112 to pivot upwardly so that flange 120 disengages rib 48, permitting carriage assembly 86 to move rearwardly an additional small distance in drawer 38. This additional rearward movement of the carriage assembly relieves any excessive pressure exterted on napkins 108 resulting from overloading the drawer with napkins.

As will be apparent from the foregoing description, one of the key features of the dispenser of the present invention is the manner in which drawer 38 is slidably mounted in cabinet 12 and carriage assembly 86 is movably mounted within the drawer. The arrangement of guides 32 and 34, ribs 50 and 52 and slides 94 and 96 provides a relatively simple and effective means for movably supporting the primary components of the dispenser relative to each other. Further, such arrangement provides not only the necessary relative movement but also securely positions the cabinet, drawer and carriage assembly in a rugged manner so that the relative positions of these components will not be changed by rough handling of the dispenser, such as by knocking it off a table or turning it over.

While the foregoing constitutes a detailed description of a perferred embodiment of the invention, various modifications thereof will occur to those skilled in the art. Therefore, the scope of the invention is to be limited solely by the scope of the appended claims.

I claim:

1. A dispenser for folded sheets of flexible material comprising:

a cabinet having a front with an opening therein, a pair of opposed sidewalls and a pair of guides respectively affixed to the inner surfaces of said cabinet sidewalls, said guides having a channel-shaped cross-section with divergent sides;

a drawer for holding a supply of said sheets having a pair of ribs respectively formed along opposite sides thereof, said ribs having a channel-shaped cross-section with divergent sides which is similar to the cross-section of said guides, said rib sides respectively interfitting with and slidably engaging said guide sides to center and movably support said drawer in said cabinet and prevent any substantial lateral or vertical movement of said drawer relative to said cabinet;

a carriage assembly for engaging the rear of said sheet supply and including a pair or slides respectively affixed to opposite sides thereof, said slides having a channel-shaped cross-section with divergent sides which is similar to the cross-sections of said ribs and said guides, said slide sides respectively interfitting with and slidably engaging said rib sides to center and movably support said carriage assembly in said drawer and prevent any substantial lateral or vertical movement of said carriage assembly relative to said drawer; and means associated with said cabinet for urging said carriage assembly forwardly of said drawer to thereby urge said sheets forwardly of said drawer and facilitate removal of said sheets individually through said cabinet front opening.

2. A dispenser as recited in claim 1, wherein said channel members, ribs and slides all have V-shaped transverse cross-sections.

3. A dispenser as recited in claim 1, wherein the outer surfaces of said rib sides engage the inner surfaces of said guide sides and the outer surfaces of said slide sides engage the inner surfaces of said rib sides.

4. A dispenser as recited in claim 1, further comprising at least one bearing member having relatively high lubricity interposed between each of said slides and the associated rib to promote sliding movement between the slides and ribs.

5. A dispenser as recited in claim 4, wherein said bearing member is made from nylon.

6. A dispenser as recited in claim 1, further comprising anti-overload means associated with said cabinet, drawer and carriage assembly to relieve any excessive pressure between said sheets caused by loading an excessive volume of said sheets into said drawer and which may result in more than one said sheet being removed through said cabinet opening upon the attempted removal of an individual said sheet.

7. A dispenser as recited in claim 6, wherein said anti-overload means comprises a lever rockably mounted on said carriage assembly, said cabinet further comprises a back, and said drawer further includes a bracket mounted at the rear thereof, and wherein when said drawer is moved forwardly in said cabinet said lever is moved downwardly under the influence of gravity to position one end of said lever to abut said drawer bracket and thereby limit rearward movement of said assembly during loading of said sheets into said drawer, and when said drawer is moved rearwardly in said cabinet the other end of said lever is adapted to slidably engage said cabinet back to move said lever upwardly and thereby allow further rearward movement of said assembly after said sheets are loaded into said drawer.

8. A dispenser as recited in claim 1, further comprising latch means connected to said drawer and engageable with said cabinet for releasably securing said drawer in said cabinet.

9. A dispenser as recited in claim 8, wherein said latch means comprises an arm pivotally mounted on said drawer and said cabinet further includes means defining a notch, said arm being releasably engageable with said notch under the influence of gravity when said drawer is fully received within said cabinet.

10. A dispenser for folded sheets of flexible material comprising:

a cabinet having sides, a back, and a front with an opening through which said sheets are dispensed;

a drawer for holding a supply of said sheets and having a bracket mounted at the rear thereof, said drawer being movable longitudinally of said cabinet between a retracted, sheet dispensing position with said bracket adjacent said cabinet back, and an extended, sheet loading position protruding from the front of said cabinet;

a carriage assembly for engaging the rear of said sheet supply and movable longitudinally of said drawer;

means associated with said cabinet for urging said carriage assembly forwardly of said drawer and facilitate removal of said sheets individually through said front cabinet opening; and anti-overload means for relieving any excessive pressure between said sheets caused by loading an excessive volume of said sheets into said drawer, comprising a two-ended lever rockably mounted on said carriage assembly with one end positioned to engage said drawer bracket and the other end positioned to engage said cabinet back, and wherein when said drawer is moved fowardly in said cabinet said lever is moved downwardly under the influence of gravity to position said one end of said lever to abut said drawer bracket and thereby limit rearward movement of said assembly during loading of said sheets into said drawer, and when said drawer is moved rearwardly in said cabinet the other end of said lever slidably engages said cabinet back to move said lever upwardly and permit said one end of said lever to clear said bracket and thereby allow further rearward movement of said assembly after said sheets are loaded into said drawer.

11. A dispenser according to claim 10 wherein said lever is rockably mounted at a location intermediate its ends and closer to said one end so that said lever has a longer back-engaging portion and a shorter bracket-engaging portion.

12. A dispenser according to claim 11 wherein said back-engaging portion extends obliquely upwardly toward said cabinet back.

* * * * *